US006022179A

United States Patent [19]

Artrip

[11] Patent Number: 6,022,179

[45] Date of Patent: Feb. 8, 2000

[54] SYSTEM AND METHOD WHEN FORMING LIFT-TAB CAN END ASSEMBLIES

[76] Inventor: Donald Artrip, 164 Kaluna Ave., Bluff City, Tenn. 37618

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/711,509

[22] Filed: Sep. 10, 1996

Related U.S. Application Data

[63] Continuation-in-part of application No. 08/014,268, May 12, 1993, Pat. No. 5,660,516.

[51] Int. Cl.[7] ..... B21D 51/44

[52] U.S. Cl. ..... 413/66; 413/25; 413/14; 413/16

[58] Field of Search ..... 413/12, 14, 16, 413/25, 66; 29/525.1, 525.2, 809, 818; 43/25, 66

[56] References Cited

U.S. PATENT DOCUMENTS

| | | | |
|---|---|---|---|
| 3,231,968 | 2/1966 | Swanson . | |
| 4,026,226 | 5/1977 | Hahn | 72/405 |
| 4,568,230 | 2/1986 | Brown | 413/66 |
| 4,723,882 | 2/1988 | Wissman | 413/66 |
| 4,762,579 | 8/1988 | Shimizu | 156/69 |
| 4,932,822 | 6/1990 | DeSilva | 413/66 |
| 5,660,516 | 8/1997 | Artrip et al. | 413/14 |

*Primary Examiner*—Jack W. Lavinder

[57] ABSTRACT

A press assembly for forming and attaching lift-tabs to can ends to form lift-tab can ends. A tab press is mounted on a frame for forming at least one lane of lift-tabs in a strip of metal stock material wherein the strip of metal stock material with the formed lift-tabs loosely attached thereto exits the tab press and is passed through either a half-twist or a half-loop to an inverted condition thereby inverting the tabs within the strip. The strip of metal stock material is further conveyed into a conversion press wherein the lift-tabs are detached from the strip and attached to the can ends. Another method of inverting and thereafter transporting the lift-tabs into the conversion press is to pass a non-inverted strip of metal stock material containing the lift-tabs into a tab punching station where the lane of lift-tabs is punched from the strip of metal stock material into a stacked lane of formed lift-tabs. A conveyor moves the stacked lane of formed lift-tabs through an inverting bend of about 180 degrees enroute from the tab punching station to a conversion press where the conversion press attaches the lift-tabs to the can ends. The lift-tabs are inverted, during the assembly-forming process, from a smooth-side-down to a smooth-side-up position for attachment to the can ends.

8 Claims, 12 Drawing Sheets

SYSTEM AND METHOD WHEN FORMING LIFT-TAB CAN END ASSEMBLIES

CROSS-REFERENCE TO RELATED APPLICATIONS

This application is a continuation-in-part of application Ser. No. 08/014,268, filed May 12, 1993, now U.S. Pat. No. 5,660,516 and entitled "Turning Easy Open Can Tops Over Automatically When These Tabs Are Made Upside Down".

BACKGROUND AND SUMMARY OF THE INVENTION

In the production of lift-tab can ends, the lift-tabs are made rough-side-up and it is necessary to invert the tabs so that they are positioned smooth side-up, prior to attachment of the tabs to can ends. This inversion has generally been accomplished manually, after the tabs are removed from the strip of metal stock material in which they are formed. It would be desirable, therefore, to provide a method wherein the tab is inverted automatically thereby saving labor.

In my invention, I provide a first press machine which makes the can end and a second press machine, or tab press, which makes the can end lift-tab. A third press machine, or conversion press, is provided which attaches the lift-tab to the can end to form a lift-tab can end. All three of the press machines are separate machines. Can ends are conveyed from the first press to the third press.

My invention does not provide a tab punch disposed at the exit of the tab press to remove the tab from the strip of material from which it is made. This would require inverting each tab prior to attaching it to a can end. Instead, a drive roller is provided on the frame of the tab press that rolls the strip of metal stock material with the formed lift-tabs loosely attached through either a half twist or a half loop to an inverted condition.

With the strip of metal stock material with the formed lift-tabs now inverted by either the half twist or the half loop, the invention provides two alternative methods of getting the lift-tabs into the proper position relative to the can ends for attachment.

The first method involves the running of the strip of metal stock material with the formed lift-tabs loosely attached through a locating means so that the strip will go into the conversion press with the lift-tabs being properly positioned with respect to a can end so that the conversion press may simultaneously detach a tab from the strip and attach the tab to a can end to form a lift-tab can end.

The second method of getting the tabs into working relationship with the can ends is to pass a strip of metal stock material with the lift-tabs formed therein through a tab punching station where a tab punch punches the formed tabs from the strip of metal stock material into at least one lane of formed tabs. A conveyor then conveys the tabs from the punching station to a conversion press. At the conversion press, the tabs are stacked smooth-side up, and a tab ejector is provided for feeding one tab at a time from the stack of tabs into the conversion press. A locating means is also provided for placing the tab into working relationship with a can end so that the conversion press may attach the tab to a can end to form a lift-tab can end.

In accordance with the broader aspects of the invention, any number of conversion presses can be employed. In addition, the invention may be used when lift-tabs are formed in rows or lanes across the width of the strip of metal stock material. In such case, the tabs from each row may be conveyed to a conversion press.

If the invention is practiced using several conversion presses and several corresponding rows or lanes of tabs, there may be times when at least one conversion press is inoperative for some reason. In such event, the tabs which are intended for the inoperative conversion press can be punched from the strip of metal stock material using a separate punch before the strip arrives at the tab punching station of the inoperative conversion press. This allows the tab press and other conversion presses to continue operating while preventing a build up of unnecessary lift-tabs at the inoperative press (or presses).

In the case where the strip of metal stock material is pressed in the tab press so that there are multiple tabs formed across its width, I can insert a commercially-available plasma cutter which will precisely separate the tab strip into individual strips of lift-tabs so that each of these individual strips may be passed through its designated conversion press. If one or more of the conversion presses become inoperative, then the tab strip or strips intended for that press or presses can be taken out of the inoperative press or presses. The tabs may be removed from that strip or strips as described above, and all other presses can continue to run. An alternative scheme involving the routing of separate tab-formed strips to their designated conversion presses is to divide the tab press stock into individual strips and pass each strip through a tab press so that each tab press produces separate strips with one lane of formed lift-tabs in each strip. Singular tab dies may be provided within the tab press bed and substituted for the usual (multiple) tab forming die. Separate paths through the press as well as separate guide means which route the strips along the separate paths are necessary when using separate and individual tab formed strips, Each strip of stock material can be propelled through the tab press by a commercially available feeder such as a Ferguson Camtrol roll feed. A second roll feed can be inserted to propel the individual tab formed strips on to the designated conversion presses.

Presses for converting ends for cans and the like are known. Presses of this type are available from the Minister Machine Company of Minister, Ohio. U.S. Pat. No. 4,568,230 shows a layout of a press for processing workpieces into finished can ends with an opening tab attached thereto.

Presses used for the manufacture of easy-open can ends generally comprise a press bed mounted on legs which rest on the floor. Four columns or uprights are mounted on the press bed. The columns or uprights support a crown in which a main drive for the press components is mounted. The columns have slides attached therein for supporting a reciprocating main ram. The main ram carries the upper tooling of the main die set, which cooperates with lower tooling on the bed to make can ends from end stock workpieces. The main die set defines a plurality of stations in which the workpieces are progressively converted into easy-open can ends. A conveyor carries the workpieces into and through the stations of the die set. The tabs are formed by tab tooling, which is supplied with strip stock by a stock feed device. The tab tooling forms a tab and separates it from the strip stock at one station for attachment to a can end at another station.

The tab tooling has conventionally been mounted on the press bed laterally of the conveyor and laterally of the main die. The tab tooling may also be split so that it is arranged laterally on both sides of the main die. A bridge is required to transfer the tab stock strip across the main die set. Such an arrangement is shown in U.S. Pat. No. 4,568,230. The upper tooling is mounted on the main ram of the press.

One of the deficiencies associated with this arrangement of the tooling is that it is difficult to access the tooling for maintenance. Access to the can end tooling is difficult due to the presence of the tab tooling on one side of the main die and the tab tooling and tab stock feed device on the other side of the main die. The lateral placement of the tab tooling also increases the depth of the press from front to back. This requires a larger bed which increases the weight of the press and reduces its speed.

The present invention overcomes the disadvantages of the laterally-placed, split tab tooling by locating the tab tooling in another press where the only tooling is the tooling associated with the tab press. Placing the tab die set in another press allows full access to the main die from either the front or back of the press. Neither the tab tooling nor its stock device obstruct access to the main die set. This placement of the tab tooling also permits a reduction in the left to right width of the press between the columns and thus a reduction in weight of the press which allows the press to run at a higher speed. Another benefit of the tab tooling placement of the present invention is that it allows servicing of the tab die within the press. Still another benefit of placing the tab tooling and the can end tooling in separate presses is that there can be an additional tab press ready to go into production at any time the tab press in operation breaks down or needs to be shut down for repairs. The advantage of the present invention is increased productivity through higher operating speed and reduced down time for maintenance and tab press stock up.

SUMMARY OF THE INVENTION

This invention resides in a process and system for use when forming lift-tab can end assemblies wherein each can end assembly includes a lift-tab having a smooth side, an opposite roughened side and a hole extending between the sides of the lift tab. The lift tab is attached to a can end having a protruding shaft integrally formed in one face thereof for receipt by, during an assembly-forming process, the hole in the lift-tab.

According to a preferred embodiment of the invention, a strip of metal stock material containing loosely attached lift-tabs is conveyed from a tab press to a conversion press. As it is conveyed, the strip is inverted either through a half-loop of about 180 vertical degrees, or a half-twist of about 180 degrees. Thus, upon entering the conversion press, the strip of metal stock material is inverted from the orientation it had when it emerged from the tab press. The strip of metal stock material is then conveyed to the conversion press, where each tab is separated from the strip of metal stock and where the tab is directly attached to the can end. The strip of metal stock can be run any reasonable distance from the tab press to the conversion press. The length of the run will determine whether any guide means are required to support the strip of metal stock. When the strip of metal stock arrives at the conversion press, the strip is directed by directing means into the correct orientation in the conversion press, where the lift-tabs are detached from the strip and attached to the can ends to form the lift-tab can end assemblies.

The system of the invention includes means for advancing formed can ends in sequence through a conversion press so that as the can ends are advanced therethrough, the shafts formed therein protrude generally upward. Means are also included for conveying a strip of metal stock through a tab press wherein a press is provided for stamping pre-shaped lift-tab workpieces in the strip so that the workpieces are loosely attached to the remainder of the strip and are oriented smooth-side-down as the workpieces move from the tab press. The conveying means is adapted to direct the strip stock which has been stamped with pre-shaped lift-tabs along a path through which the strip stock is inverted so that as each pre-shaped lift tab moves into the conversion press, the lift tab is positioned smooth-side up.

The system also includes means for directing the tab formed strip to a location at which a lift tab is disposed above a can end in the conversion press. The directing means is coordinated with the can end conveying means so that as each can end is advanced into position at the conversion press, a lift tab within the tab formed strip is moved above the can end so that the hole in the lift-tab is positioned in registry with the upwardly-directed shaft formed in the can end. A press is provided for deforming the shaft in a manner which joins the lift-tab to the can end to form a lift-tab can end.

DETAILED DESCRIPTION OF THE ILLUSTRATED EMBODIMENTS

Figure 12:
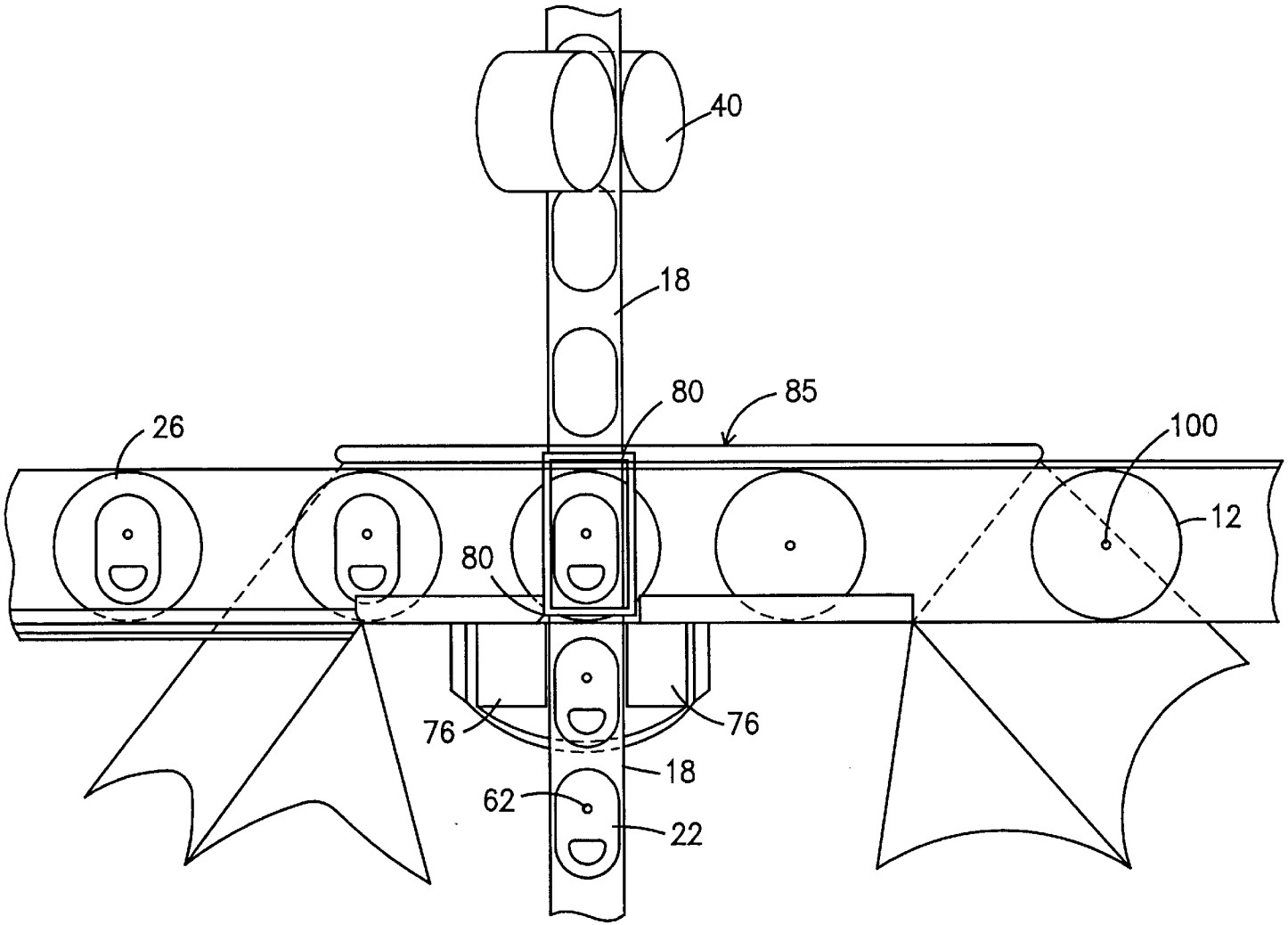
FIG. 12 is a view showing the guide means for guiding the tab formed strip into the conversion press and also a bridge which guides the tab strip over the bed of the conversion press.

The station in a can end conversion press where the lift-tab is attached to the can end is referred to herein as the attachment station. As shown in FIG. 12, can ends 12 are conveyed across the conversion press bed 85 by conventional conveyor drive means (not shown), and a strip 18 of metal stock material with formed lift-tabs 22 is conveyed over the top of the can ends by drive 40. Rivet 100 is generally located in the center of can end 12. In order to properly attach a lift tab to a can end, therefore, lift-tab rivet hole 62 in lift-tab 22 must be aligned with can end rivet 100 on the downstroke of the conversion press after the can end has moved into the attachment station. Guides 76 and bridge 80 help to insure that tab strip 18 is properly aligned with the can ends as the lift-tabs in strip 18 are conveyed over the attachment station. Bridge 80 raises the tab formed strip 18 above the can end rivet, and the guides, which are parallel and separated by a distance substantially equal to the width of the strip, ensure that the strip is introduced to the conversion press bed at the correct orientation or angle.

Since all of the lift-tabs are formed in the same relative position along the length of strip 18, the measured perpendicular distance from a point on an edge of the strip to the center of the lift-tab rivet hole is always the same. This means that the rivet hole of the lift-tab always passes over the same point as the strip moves through the attachment position of the conversion press. The incremental linear movement of the strip is synchronized with the movement of the can ends through the conversion press so that each time the conversion press reciprocates, the rivet hole of a lift-tab is aligned with the rivet of a can end. In intermittent moves synchronized to the open cycles of the conversion press, the tab formed strip is moved so as to place a tab above a can end. As the upper die (not shown) of the conversion press is actuated, the lift-tab is detached from the strip and placed upon the can end. As the die completes its downward attachment stroke, the lift-tab is riveted to the can end to form a lift-tab can end 26.

Figure 2:
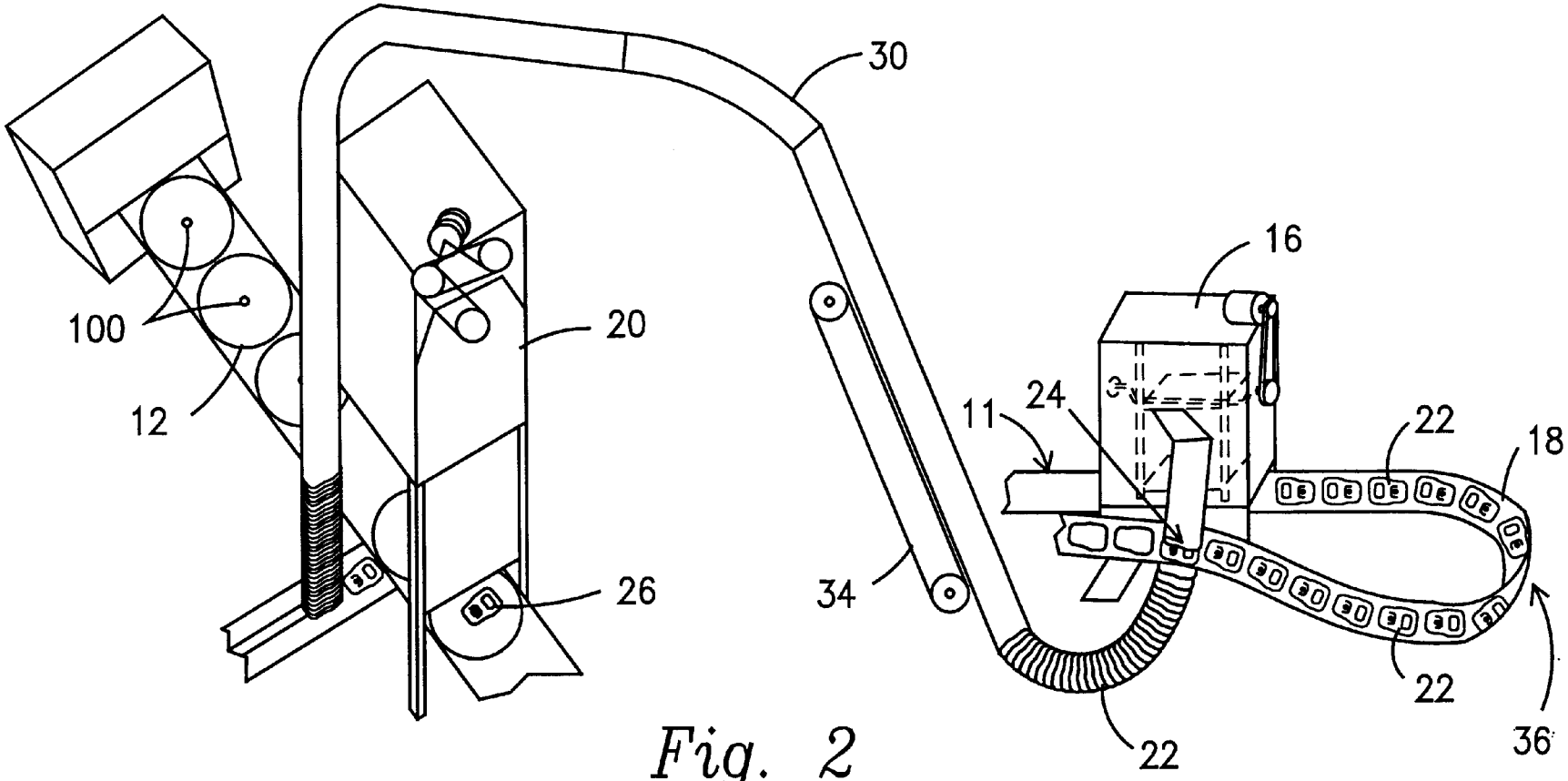
FIG. 2 is a view showing a tab formed strip emerging from a tab press, passing through a half-loop, further passing into a tab punching station where a lane of tabs is punched from the tab strip and the tabs are thereafter conveyed to a conversion press and attached to can ends.
Figure 11:
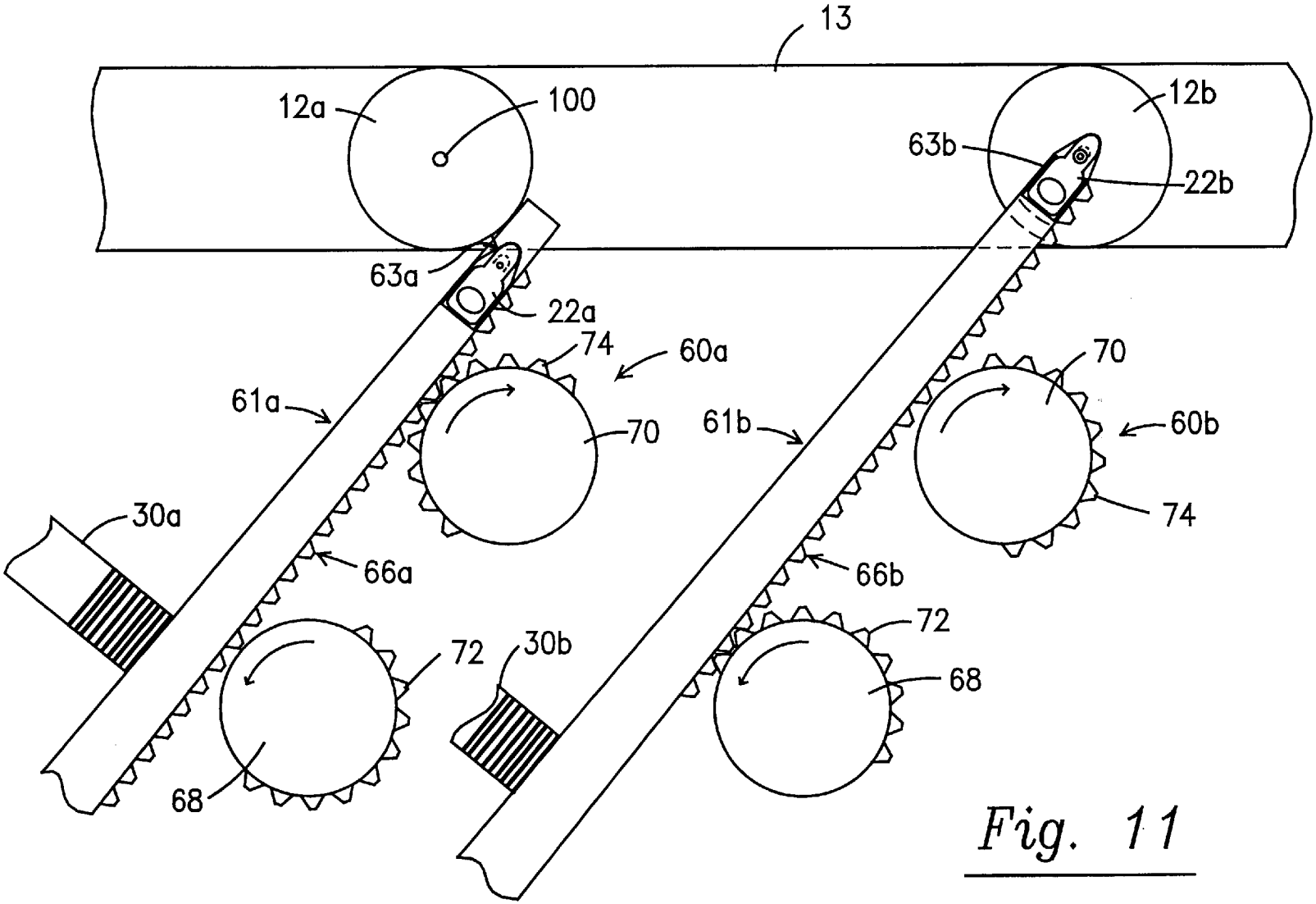
FIG. 11 is a schematic representation of how the tab ejector works.

FIG. 2 illustrates one case where lift-tabs formed in tab press 16 are punched out of strip 18 and conveyed in a stacked relationship to the conversion press 20. Locating means or conveyor 30 is provided for directing the punched lift-tabs downwardly to a position disposed to one side of the attachment station of conversion press 20, and an alignment means such as alignment means 60 (see FIG. 11) is provided for moving each lift-tab from a position adjacent to the attachment station to a location at which the lift-tab is disposed above the can end positioned in the attachment station. FIG. 11 shows a pair of reciprocating alignment means or tab ejectors 60*a* and 60*b* operating in tandem so that each aligns a tab for attachment to every second can end 12 moving from left to right (as shown in FIG. 11) on can end conveyor 13. Each tab ejector is coordinated with the can end conveyor so that as each can end 12 is advanced into position at the attachment station, a corresponding lift-tab 22 is moved above the can end so that the rivet hole 62 in the lift-tab is positioned over the upwardly-protruding rivet 100 formed in the can end. Tab ejector 60*a*, for example, operates to move the lowermost lift-tab out of the stack of lift-tabs from conveyor or chute 30*a* and onto the top of can end 12*a* on conveyor 13. As shown in FIG. 11, tab ejector 60*a* has conveyed lift tab 22*a* part-way towards can end conveyor 13 for placement on can end 12*a*. Tab ejector 60*b* operates to move the lowermost lift-tab out of the stack of lift-tabs from conveyor or chute 30*b* and onto the top of can end 12*b* on conveyor 13. As shown in FIG. 11, tab ejector 60*b* has conveyed tab 22*b* to its point of placement on can end 12*b*. The construction and operation of both tab ejectors is identical. Thus, for example, tab ejector 60*a* includes slide 61*a* and tab seat 63*a*. The tab ejector is slightly higher than the can end in the attachment station so that it may be operated to convey a lift tab to an attachment position just above a can end. Reciprocating tab seat 63*a* slides back and forth under the influence of rack 66 (on one side of slide 61) and partially geared pinions 68 and 70 (which are preferably designed to turn simultaneously at the same speed of rotation). When the tab seat is in the retracted position (not shown), it may receive a lift tab from chute or conveyor 30. At the time that a tab is placed within the tab seat, gear teeth 74 on pinion 70 will be just engaging the teeth on rack 66. The clockwise rotation (as shown in FIG. 11) of pinion 70 will carry tab seat 63 along slide 61 towards can end conveyor 13. As the tab seat reaches the end of the slide (see ejector 60*b* of FIG. 11), the tab seat is retracted or pulled from under the lift-tab, thus allowing the lift-tab to drop onto the can end with the tab rivet hole over the upwardly protruding can end rivet. At this point, gear teeth 74 on pinion 70 disengage from the teeth on rack 66 and gear teeth 72 on pinion 68 engage the teeth on rack 66 to move the tab seat in the opposite direction to the retracted position.

Figure 1:
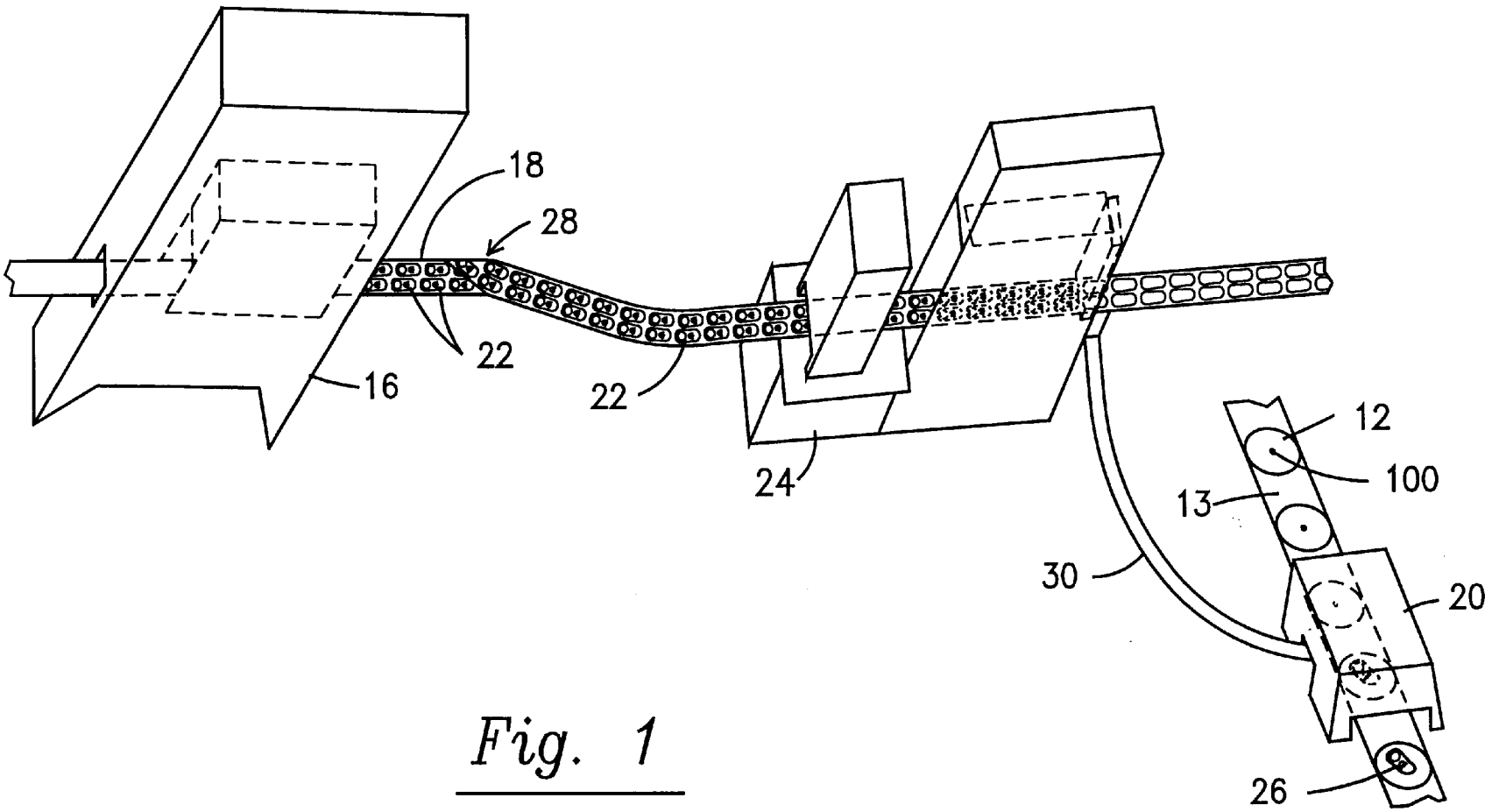
FIG. 1 is a view showing a tab formed strip emerging from a tab press, passing through a half-twist, further passing into a tab punching station where a lane of tabs is punched from the tab strip and the tabs are thereafter conveyed to a conversion press and attached to can ends.

Referring now to FIG. 1, a schematic representation of a preferred embodiment of a system of the invention is illustrated. This system includes tab press 16, tab punching station 24 and conversion press 20. Strip 11 of metal stock is passed into the tab press where lift-tabs 22 are formed therein (rough side up as shown in FIG. 1). Strip 18 with tabs loosely attached thereto is then passed through a half twist 28 before reaching the tab punching station 24. It follows that as the strip 18 passes through the half twist, the tabs formed in the strip are inverted from rough side up to smooth side up. At tab punching station 24, the tabs are punched from strip 18 and into a chute or conveyor 30 which conveys the tabs to the conversion press 20. Can ends 12 are conveyed into the conversion press by can end conveyor 13. Lift-tabs are attached to the can ends in the conversion press to make lift tab can ends 26. Where it is desired for strip 18 to pass through a half twist, when the strip is initially loaded into the tab press and tab punch, the person or machine loading the strip must create the half twist by rotating the strip 180 degrees prior to feeding the strip into the tab punch. Once the half twist has been introduced, its position will be maintained by the tension and speed at which the strip is passed between the tab press and tab punch.

FIG. 2 is a schematic representation of an alternative embodiment of the system of FIG. 1. As shown therein, lift-tabs 22 are punched into metal strip 11 at tab press 16, and strip 18 of metal stock with the tabs loosely attached is inverted through a half loop 36 before the tabs are removed from the strip at punching station 24. Conveyor 30 moves tabs 22 by means of drive 34 to a position adjacent to conversion press 20. Conveyor 13 moves can ends 12 into the conversion press, where tabs are applied thereto to make lift tab can ends 26.

Figure 3:
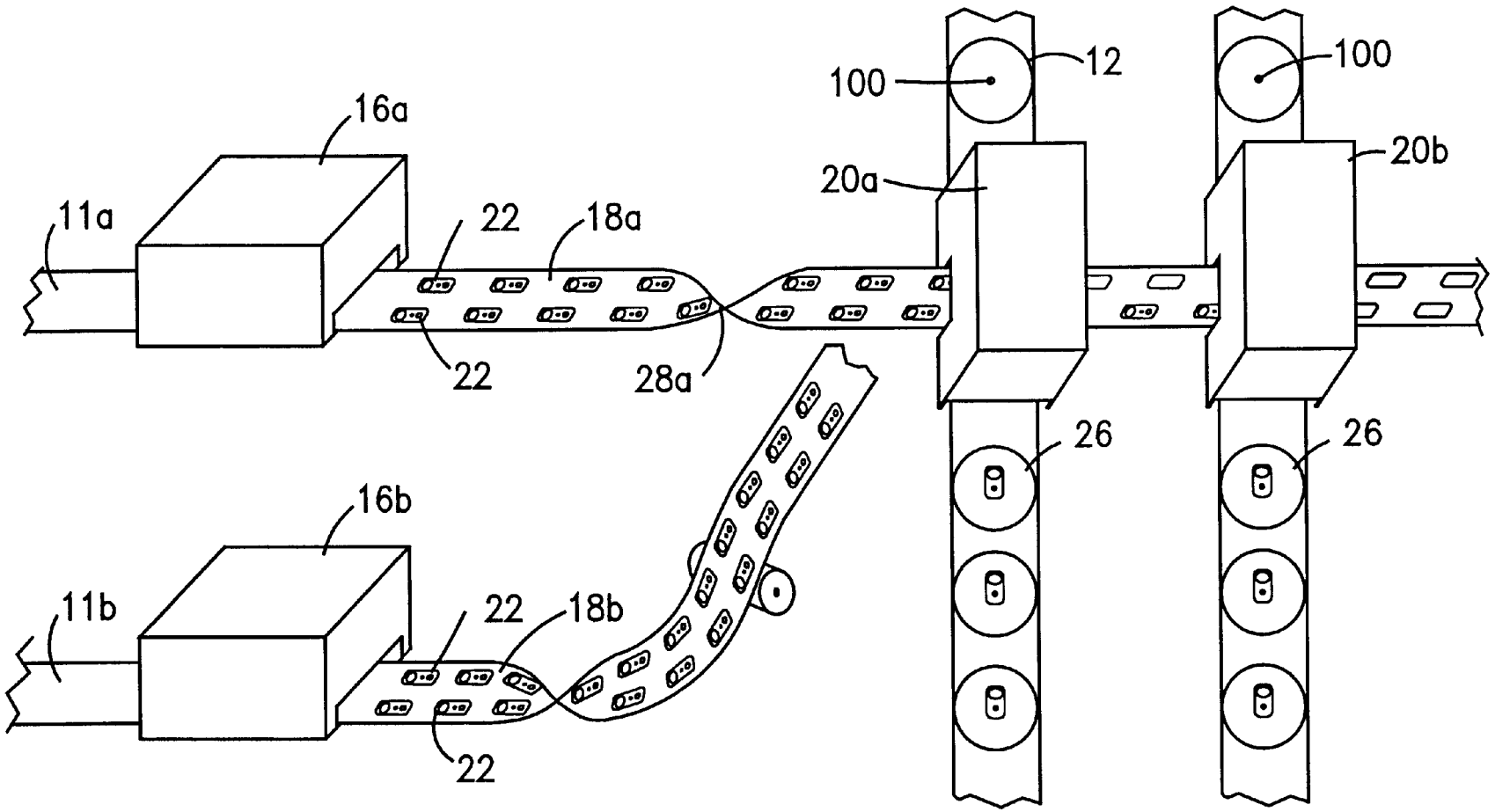
FIG. 3 is a view showing a tab formed strip emerging from a tab press, passing through a half-twist, and further passing through two conversion presses where a lane of tabs is detached from the tab strip and attached to a row of can ends in the first conversion press and the other lane of tabs is used in the second conversion press in the same way. An additional tab press in a standby mode is also shown.

FIG. 3 illustrates a system involving two tab-forming presses 16*a* and 16*b* and a pair of conversion presses 20*a* and 20*b*. In this system, a strip 18*a* with two rows of lift-tabs 22 loosely attached thereto is passed through a half-twist 28*a* following its exit from tab press 16*a* and before it passes into conversion press 20*a*. Conversion press 20*a* attaches the tabs 22 of one row of the strip to a series of can ends 12 routed through the press 20*a* while the other conversion press 20*b* attaches the tabs of the other row of the strip 18*a* to another series of can ends being conveyed through press 20*b*. Tab press 16*b* is an auxiliary tab press which remains in a standby mode until the first press 16*a* is shut down.

Figure 4:
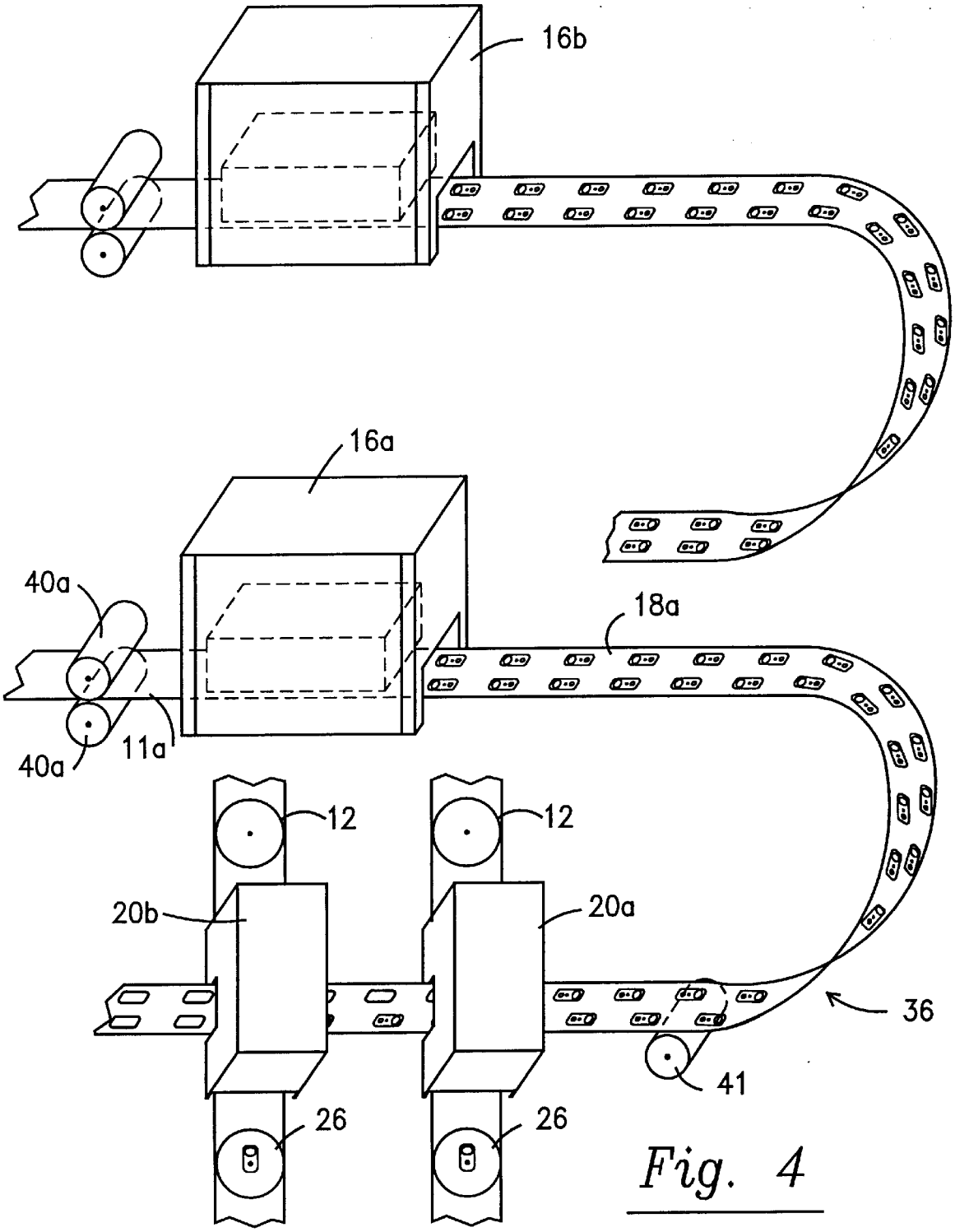
FIG. 4 is a view showing a tab formed strip emerging from a tab press, passing through a half-loop, and further passing through two conversion presses where a lane of tabs is detached from the tab strip and attached to a row of can ends in the first conversion press and the other lane of tabs is used in the second conversion press in the same way.

FIG. 4 illustrates a system in which strip 11*a* of metal stock is driven by rollers 40*a* through tab press 16*a* where tabs 22 are punched into two lanes in the strip. The resulting strip 18*a* with tabs loosely attached thereto is inverted through a half loop 36 and the strip is passed over guide roller 41 into conversion press 20*a*, where one lane of tabs 22 is punched out and attached to can ends 12. The strip with one lane of tabs removed is then passed into conversion press 20*b*, which attaches the tabs of the other row of the strip 18*a* to another series of can ends being conveyed through press 20*b*. Tab press 16*b* is an auxiliary tab press which remains in a standby mode until the first press 16*a* is shut down.

Figure 5:
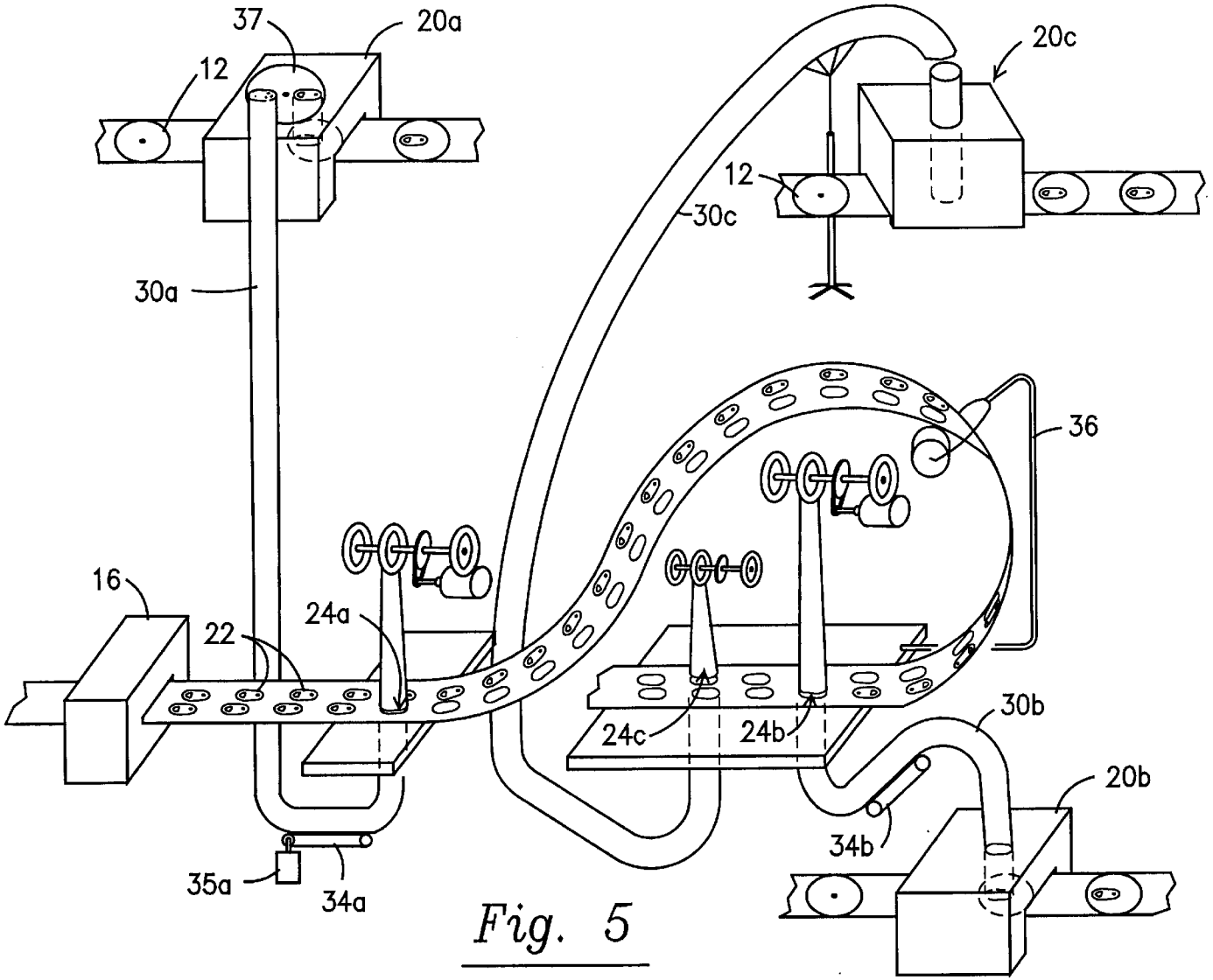
FIG. 5 is a view showing a strip of tabs exiting a tab press. One lane of tabs is punched from the uninverted part of the strip into a tab conveyor routed through a 180 degree vertical bend enroute to a conversion press. The tab strip further passes through a half-loop and thereafter another lane of tabs is punched into a tab conveyor traversing, two 180 degree vertical bends enroute to a conversion press.

FIG. 5 is a schematic representation of a system including a tab press 16, in which lift-tabs 22 are formed in two lanes in a strip of metal stock material 18. Tabs 22 are punched from one lane of the strip of formed tabs by tab punch 24*a* and conveyed by drive 34*a* (driven by motor 35*a*) through chute 30*a* to a location adjacent to conversion press 20*a* where the tabs are arranged in a stacked relationship by wheel 37. A tab ejector (not shown) moves each tab into position for attachment to can ends within the conversion press 20*a*. It can be seen in FIG. 5 that the tabs are inverted as they are routed to the attachment station from punch 24*a*. The strip 18 from which one lane of tabs has been removed by punch 24*a* is passed through a half-loop inversion by guide 36 and conveyed to a second punch 24*b* where the remaining tabs are removed. These tabs are then conveyed by conveyor 30*b*, driven by drive 34*b*, to conversion press 20*b* where the tabs are attached to can ends 12.

At another station within the system illustrated in FIG. 5, tab punch 24*c* may be used instead of punch 24*a* to remove a lane of tabs from tab formed strip 18. These tabs may be conveyed by conveyor 30*c* to conversion press 20*c*.

Figure 6:
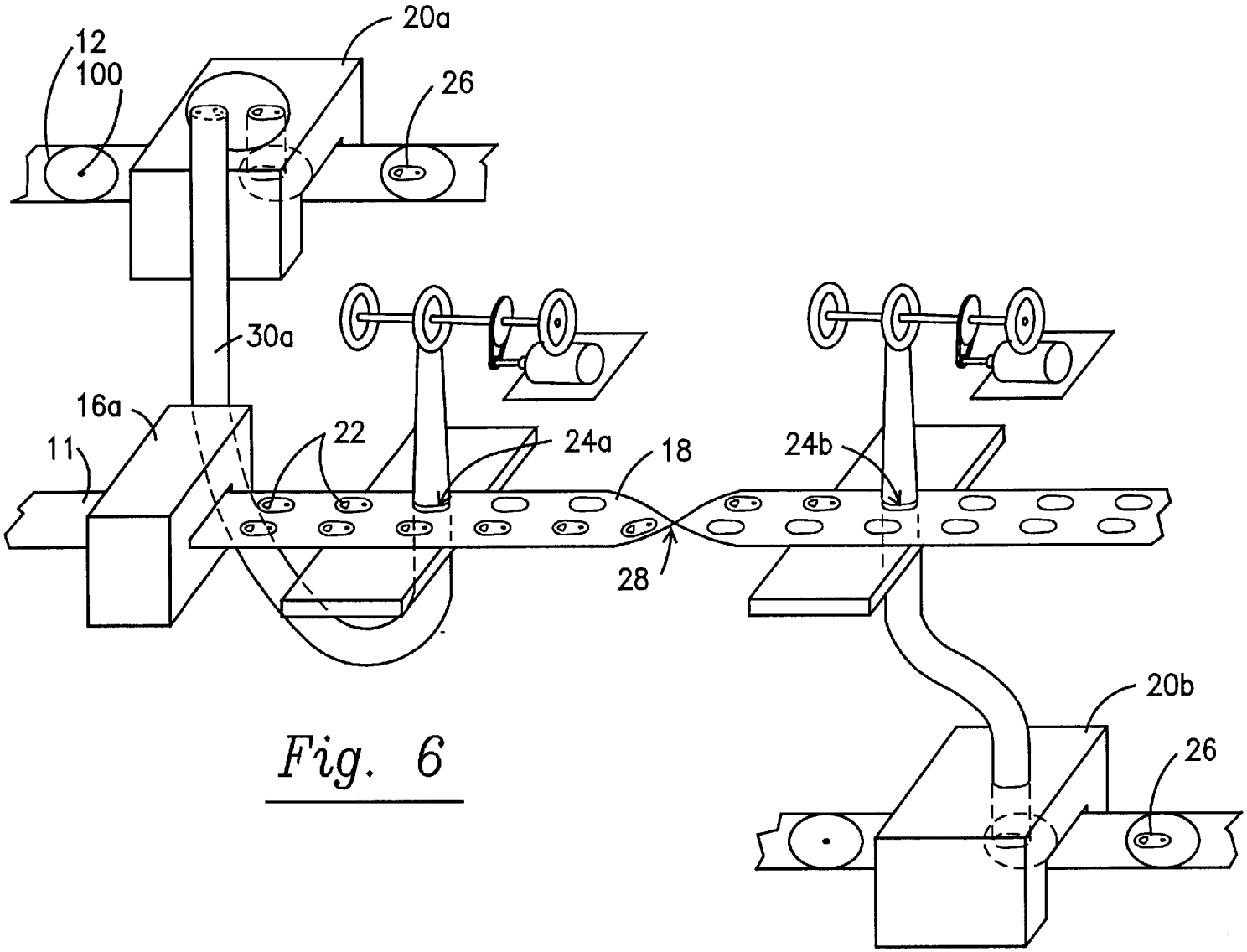
FIG. 6 is a view of a tab formed strip exiting a tab press. Tabs are punched into a chute and conveyed through a 180 degree vertical bend and to a conversion press. The tab strip is further conveyed through a half-twist and thereafter tabs are punched into a lane of tabs which is conveyed through two 180 degree vertical bends enroute to a conversion press.

FIG. 6 illustrates another embodiment of the invention, in which tab press 16*a* may be used to produce tabs 22 in strip 11. Tab punch 24*a* may be used to remove one lane of tabs from tab formed strip 18. These tabs are conveyed by conveyor 30*a* to conversion press 20*a*, and are inverted enroute from rough side up to smooth side up. Tab strip 18 is also inverted through half twist 28, and a second lane of tabs may be removed therefrom by tab punch 24*b*. Tabs removed from tab strip 18 by punch 24*b* are conveyed to conversion press 20*b*, where the tabs are attached to can ends 12 to make lift tab can ends 26.

Figure 7:
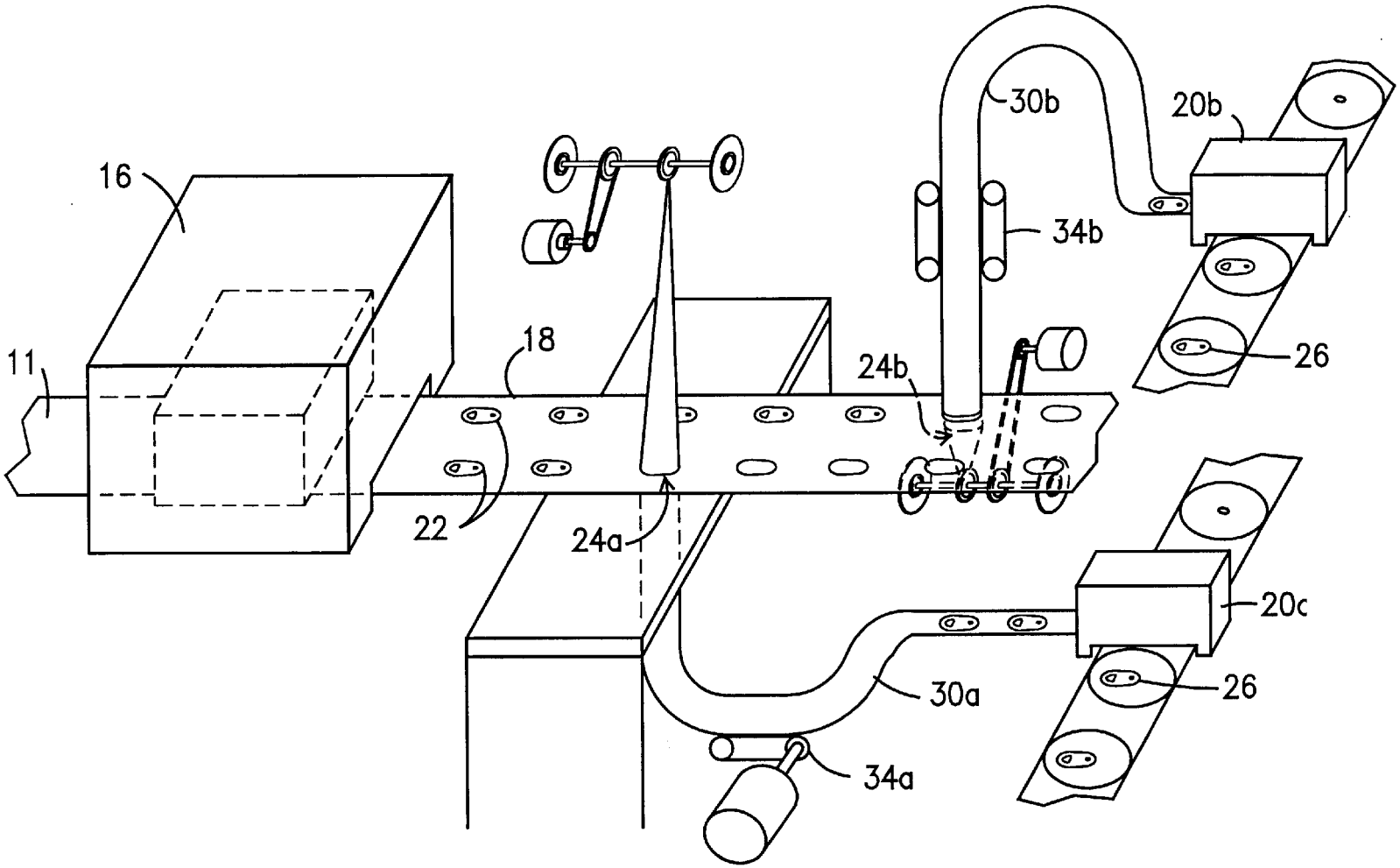
FIG. 7 is a schematic representation of a system wherein tabs are punched from a tab formed strip and inverted 180 degrees before being passed to a station at which the tabs are attached to can ends to form lift-tab can ends.

FIG. 7 is a schematic representation of an alternative embodiment of the invention in which a strip 11 of metal stock material is fed into tab press 16, which presses lift-tabs therein. Thereafter tab formed strip 18 with two lanes of tabs 22 formed therein is conveyed to tab punch 24*a*, which removes one lane of the tabs. These tabs are inverted by transport through a 180 degree vertical bend in conveyor 30*a* (driven by drive 34*a*) and conveyed to conversion press 20*a*. The tab formed strip with the remaining lane of tabs is conveyed to tab punch 24*b* which removes the tabs therefrom. The second lane of tabs is inverted by transport through a 180 degree vertical bend in conveyor 30*b* as they are conveyed to conversion press 20*b*. The tabs are removed from the tab conveyors upon arrival at a conversion press by a tab ejector (not shown) which aligns a tab over a can end in the conversion press.

Figure 8:
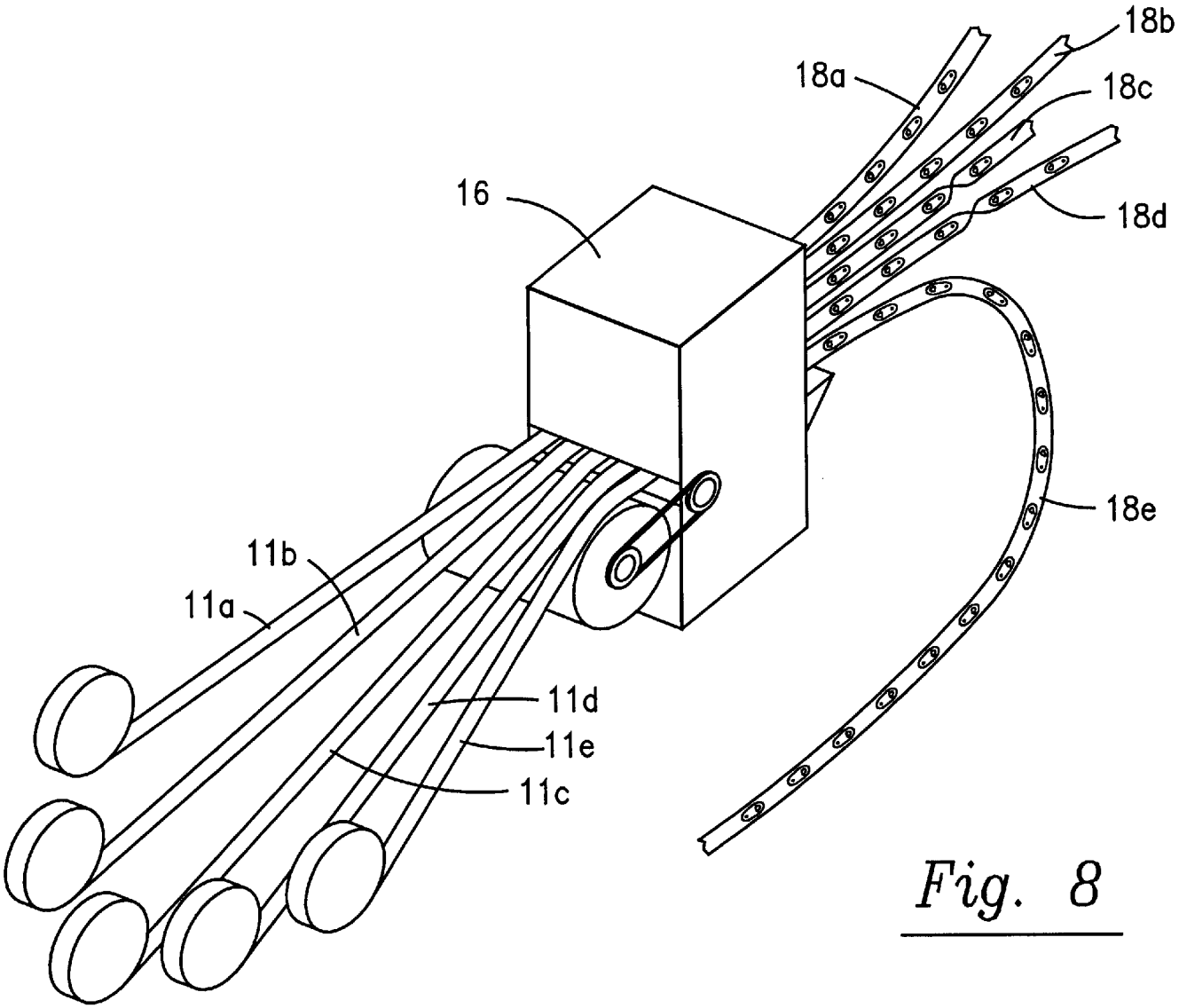
FIG. 8 is a view showing multiple strips of metal stock material going through a tab press forming multiple tab formed strips.

FIG. 8 illustrates an embodiment of tab press 16, in which lift-tabs are formed in a plurality of strips of metal stock material 11*a*, 11*b*, 11*c*, 11*d*, and 11*e*. Each of strips 18*a*, 18*b*, 18*c*, 18*d* and 18*e* with lift-tabs formed therein may be conveyed to a conversion press in accordance with the invention.

Figure 9:
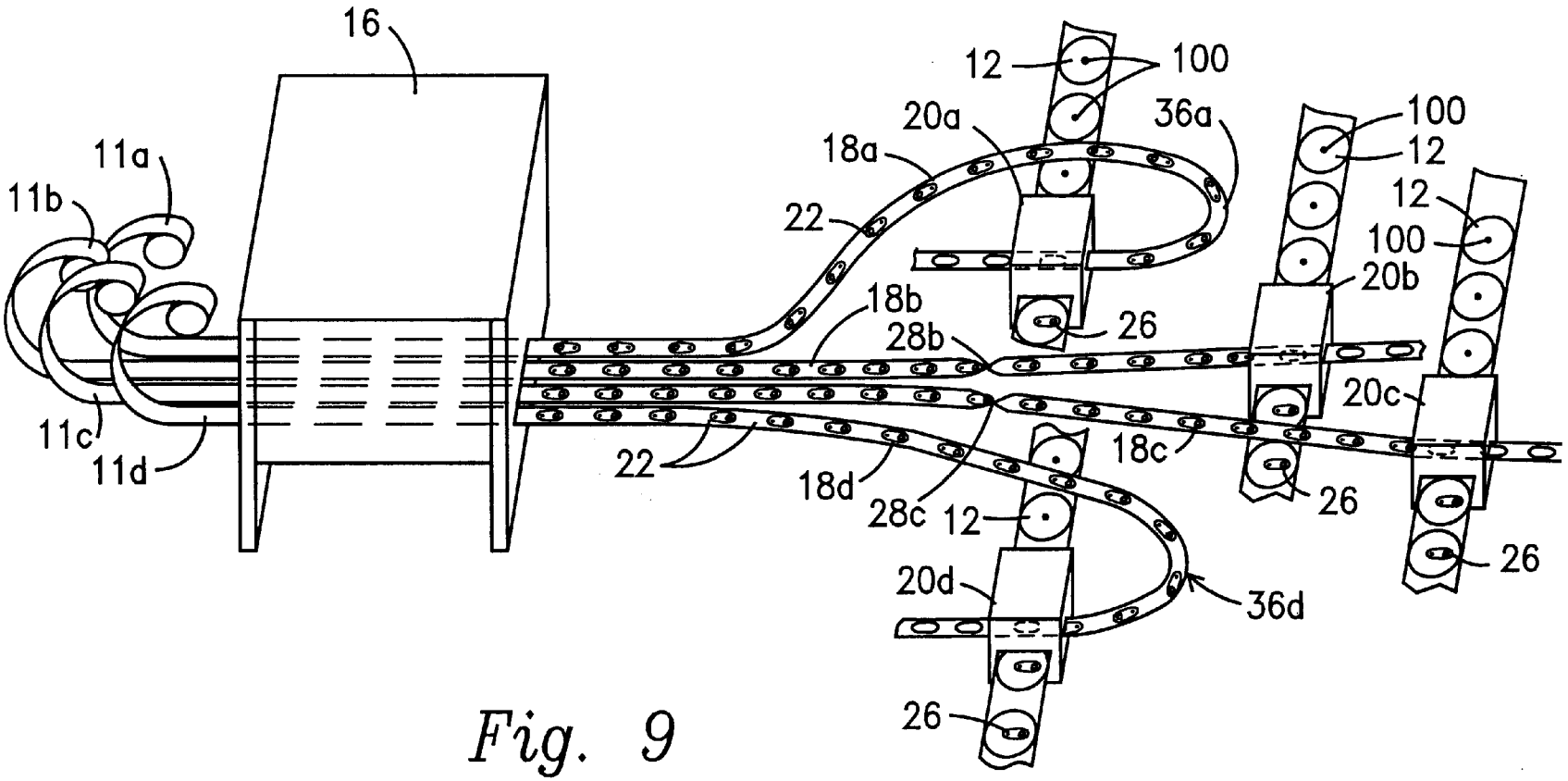
FIG. 9 is a view of multiple tab formed strips going through designated conversion presses where tabs are detached from the strips and attached to can ends to form lift-tab can ends.

FIG. 9 illustrates an embodiment of tab press 16 in which lift-tabs may be formed in a plurality of strips of metal stock material 11*a*, 11*b*, 11*c* and 11*d*. Tab formed strips 18*a*, 18*b*, 18*c* and 18*d* are conveyed from the tab press to conversion presses 20*a*, 20*b*, 20*c* and 20*d* respectively. Strips 18*a* and 18*d* are inverted through half loops 36*a* and 36*d*, respectively, prior to introduction to the conversion press. Strips 18*b* and 18*c* are inverted through half twist 28*b* and 28*c*, respectively.

Figure 10:
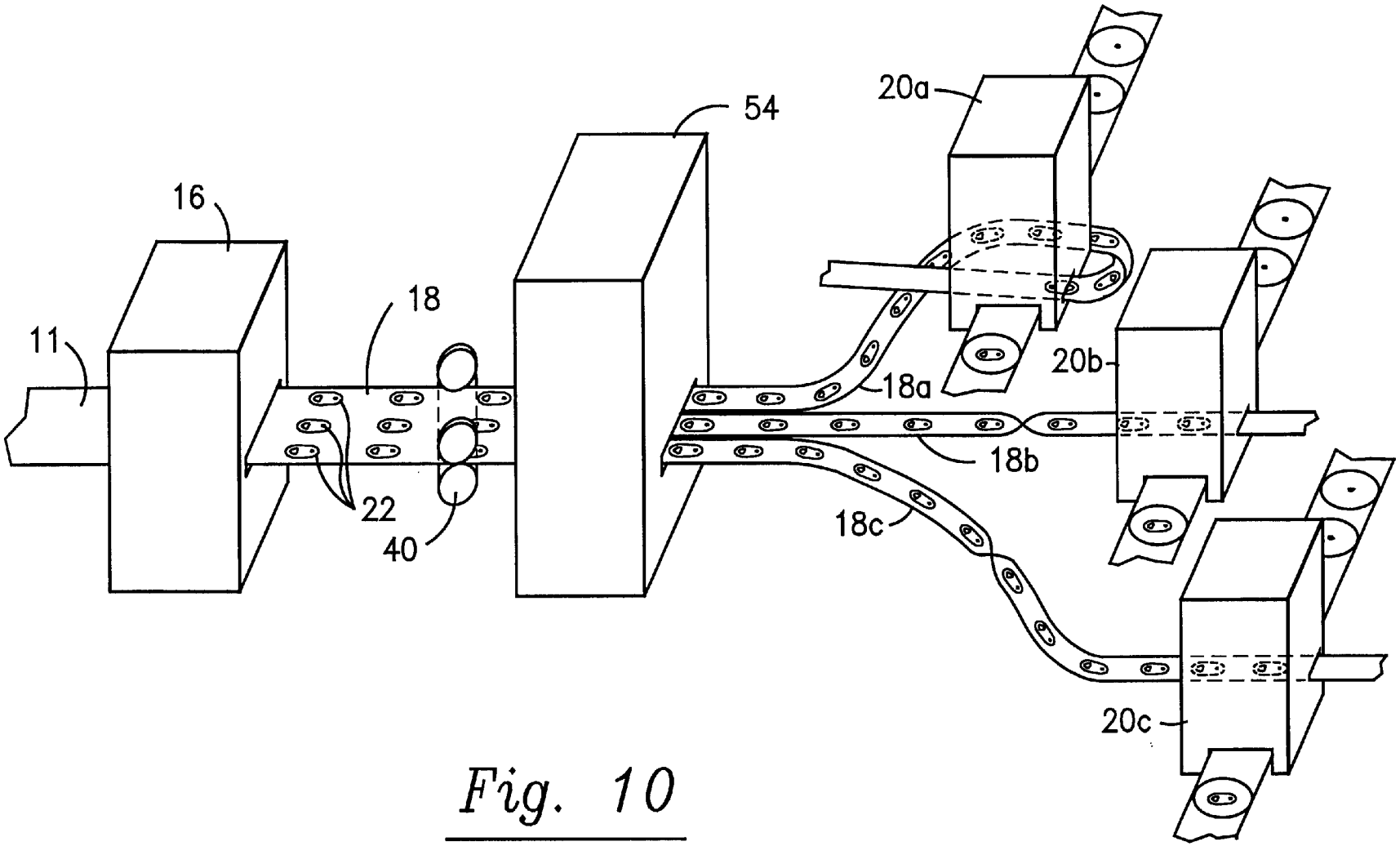
FIG. 10 is a view showing a multiple lane tab formed strip moving through a cutter which divides the strip into multiple strips containing one lane of tabs each. Each strip of tabs is propelled through a designated conversion press where each tab is detached from the strip and attached to a can end.

The embodiment of the invention illustrated in FIG. 10 includes tab press 16 which forms three lanes of tabs in a strip 11 of metal stock material. Driver 40 conveys the resulting tab formed strip 18 into plasma cutter 54, which divides the strip into three strips 18*a*, 18*b* and 18*c*, each containing one lane of tabs. These strips are then inverted and conveyed to conversion presses 20*a*, 20*b* and 20*c* for removal of the tabs from the strip and attachment of the tabs to can ends.

What is claimed is:

1. A system for forming and attaching lift-tabs to can ends to form lift-tab can ends, said system comprising:

a tab press mounted on a frame and being adapted for forming at least one lane of lift-tabs in a strip of metal stock material;

a means for passing the strip of metal stock material with the formed lift-tabs loosely attached thereto through a half loop to an inverted condition before entering a tab punching station;

a drive roller supported on the frame of the tab press for moving the strip of metal stock material through the tab press;

said tab punching station having a tab punch for punching the formed tabs from the strip of metal stock material into at least one lane of formed tabs;

a conveyor means for conveying the at least one lane of formed tabs from the tab punching station to a conversion press;

said conversion press being adapted to attach a tab onto a can end, and having a tab ejector which is adapted for feeding one tab at a time into the conversion press and a locating means for placing a tab into working relationship with a can end so that the conversion press may attach the tab onto the can end to form a lift-tab can end.

2. A system for forming and attaching lift-tabs to can ends to form lift-tab can ends, said system comprising:

a tab press, and a conversion press, each capable of independent operation;

said tab press mounted on a frame and being adapted for forming at least one lane of lift-tabs in a strip of metal stock material;

a means for passing the strip of metal stock material with the formed lift-tabs loosely attached thereto through a half twist to an inverted condition before entering a conversion press;

a drive roller supported on the frame of the tab press for moving the strip of metal stock material through the tab press;

a conveyor means for conveying the strip of metal stock material with the formed lift-tabs loosely attached from the tab press to a conversion press;

said conversion press being adapted to detach a tab from the strip of metal stock material and attach said tab onto a can end, and having a locating means for placing the strip of metal stock material into the conversion press with the tab being placed into working relationship with a can end so that the conversion press may detach the tab from the strip and attach the tab onto the can end to form a lift-tab can end.

3. A system for forming and attaching lift-tabs to can ends to form lift-tab can ends, said system comprising:

a tab press, and a conversion press, each capable of independent operation;

said tab press mounted on a frame and being adapted for forming at least one lane of lift-tabs in a strip of metal stock material;

a means for passing the strip of metal stock material with the formed lift-tabs loosely attached thereto through a half loop to an inverted condition before entering a conversion press;

a drive roller supported on the frame of the tab press for moving the strip of metal stock material through the tab press;

a conveyor means for conveying the strip of metal stock material with the formed lift-tabs loosely attached from the tab press to a conversion press;

said conversion press being adapted to detach a tab from the strip of metal stock material and attach said tab onto a can end, and having a locating means for placing the strip of metal stock material into the conversion press with the tab being placed into working relationship with a can end so that the conversion press may detach the tab from the strip and attach the tab onto the can end to form a lift-tab can end.

4. A system for forming and attaching lift-tabs to can ends to form lift-tab can ends, said system comprising:

a tab press mounted on a frame for forming at least one lane of lift-tabs in each of a plurality of strips of metal stock material;

a means for passing each of the strips of metal stock material with the formed lift-tabs loosely attached thereto through a half-twist to an inverted condition before entering a conversion press;

a drive roller supported on the frame of the tab press for moving multiple strips of metal stock material through the tab press;

conveyor means for conveying each strip of metal stock material with the formed lift-tabs loosely attached thereto from the tab press to a designated conversion press;

said conversion press being adapted to detach a tab from the strip of metal stock material and attach said tab onto a can end, and having a locating means for placing the strip of metal stock material into the conversion press with the tab being placed into working relationship with a can end so that the conversion press may detach the tab from the strip and attach the tab onto the can end to form a lift-tab can end.

5. A system for forming and attaching lift-tabs to can ends to form lift-tab can ends, said system comprising:

a tab press mounted on a frame for forming at least one lane of lift-tabs in a strip of metal stock material;

a drive roller supported on the frame of the tab press for moving the strip of metal stock material through the tab press;

a means for removing lift-tabs from the strip of metal stock material;

a means for passing the strip of metal stock material with the formed lift-tabs loosely attached thereto through a tab punching station, said tab punching station being adapted to remove at least one lane of formed tabs from the strip of metal stock material and deposit said formed tabs onto a tab conveyor, said tab conveyor being provided with a 180 degree vertical bend in order to invert the formed tabs thereon, and said tab conveyor being adapted to convey the inverted formed tabs to a conversion press, said conversion press being adapted to attach a tab onto a can end to form a lift-tab can end;

a rotating wheel which is located adjacent to the conversion press and which is adapted for removal of lift-tabs from the tab conveyor and for depositing said lift-tabs into a lift-tab chute which directs lift-tabs downward to a tab ejector which is located at the tab attachment station, and which is adapted to place a lift-tab in correct alignment above a can end;

a means for activating the conversion press when a lift-tab is in the correct alignment above a can end so as to attach the lift-tab onto the can end and thereby form a lift-tab can end.

6. A system for forming and attaching lift-tabs to can ends to form lift-tab can ends, said system comprising:

a tab press mounted on a frame for forming at least one lane of lift-tabs in each of a plurality of strips of metal stock material;

a means for passing each of the strips of metal stock material with the formed lift-tabs loosely attached thereto through a half-loop to an inverted condition before entering a conversion press;

a drive roller supported on the frame of the tab press for moving multiple strips of metal stock material through the tab press;

conveyor means for conveying each strip of metal stock material with the formed lift-tabs loosely attached thereto from the tab press to a designated conversion press;

said conversion press being adapted to detach a tab from the strip of metal stock material and attach said tab onto a can end, and having a locating means for placing the strip of metal stock material into the conversion press with the tab being placed into working relationship with a can end so that the conversion press may detach the tab from the strip and attach the tab onto the can end to form a lift-tab can end.

7. A system for forming and attaching lift-tabs to can ends to form lift-tab can ends, said system comprising:

a tab press mounted on a frame for forming a plurality of lanes of lift-tabs in a strip of metal stock material, said tab press including a means for separating the strip of metal stock material into a plurality of separated strips, with each such separated strip having a lane of lift-tabs formed therein;

a means for passing each of the separated strips of metal stock material with the formed lift-tabs loosely attached thereto through a half-twist to an inverted condition after passing from the tab press and before entering a conversion press;

a drive roller supported on the frame of the tab press for moving the strip of metal stock material into the tab press;

conveyor means for conveying each strip of metal stock material with the formed lift-tabs loosely attached thereto from the tab press to a designated conversion press;

said conversion press being adapted to detach a tab from the strip of metal stock material and attach said tab onto a can end, and having a locating means for placing the strip of metal stock material into the conversion press with the tab being placed into working relationship with a can end so that the conversion press may detach the tab from the strip and attach the tab onto the can end to form a lift-tab can end.

8. A system for forming and attaching lift-tabs to can ends to form lift-tab can ends, said system comprising:

a tab press mounted on a frame for forming a plurality of lanes of lift-tabs in a strip of metal stock material, said tab press including a means for separating the strip of metal stock material into a plurality of separated strips, with each such separated strip having a lane of lift-tabs formed therein;

a means for passing each of the separated strips of metal stock material with the formed lift-tabs loosely attached thereto through a half-loop to an inverted condition after passing from the tab press and before entering a conversion press;

a drive roller supported on the frame of the tab press for moving the strip of metal stock material into the tab press;

conveyor means for conveying each strip of metal stock material with the formed lift-tabs loosely attached thereto from the tab press to a designated conversion press;

said conversion press being adapted to detach a tab from the strip of metal stock material and attach said tab onto a can end, and having a locating means for placing the strip of metal stock material into the conversion press with the tab being placed into working relationship with a can end so that the conversion press may detach the tab from the strip and attach the tab onto the can end to form a lift-tab can end.

* * * * *